United States Patent [19]

Dvorak et al.

[11] Patent Number: 4,467,156

[45] Date of Patent: Aug. 21, 1984

[54] LIQUID LEVEL SENSOR SWITCH

[75] Inventors: Edwin A. Dvorak, Redford; George Nagy, Jr., Canton; Boris Puscasu, Dearborn Heights; Gary A. Pniewski, Plymouth, all of Mich.

[73] Assignee: Ford Motor Company, Dearborn, Mich.

[21] Appl. No.: 456,928

[22] Filed: Jan. 10, 1983

[51] Int. Cl.[3] ..... H01H 35/18

[52] U.S. Cl. ..... 200/84 R

[58] Field of Search ..... 200/84 R, 84 A, 84 B, 200/84 C, 84; 184/103 A; 340/603, 606, 623–625

[56] References Cited

U.S. PATENT DOCUMENTS

| | | | |
|---|---|---|---|
| 1,280,222 | 10/1918 | Hester | 184/103 A |
| 1,768,446 | 6/1930 | Gron | 200/84 R |
| 2,479,503 | 8/1949 | Moore | 200/84 R |
| 2,520,237 | 8/1950 | Cleary | 200/84 A |
| 3,605,086 | 9/1971 | Triska | 340/59 |
| 3,750,124 | 7/1973 | Barnes et al. | 340/244 E |
| 3,774,187 | 11/1973 | Windham | 340/624 |
| 3,939,470 | 2/1976 | Arai et al. | 340/59 |

FOREIGN PATENT DOCUMENTS

| | | | |
|---|---|---|---|
| 394356 | 11/1965 | Switzerland | 200/84 B |

*Primary Examiner*—J. R. Scott

*Attorney, Agent, or Firm*—Paul K. Godwin, Jr.; Robert D. Sanborn

[57] ABSTRACT

A liquid level sensor switch to indicate whether a sensed liquid is above or below a predetermined level utilizing a generally cylindrical float element that is slightly ballasted along its length so that it is self-orienting with respect to the vertical. Electrically connected contacts are placed at opposite ends of the ballasted float element and are maintained in a proper downward orientation so as to connect and disconnect an electrically conducting path when the liquid level changes about a predetermined level.

10 Claims, 2 Drawing Figures

LIQUID LEVEL SENSOR SWITCH

BACKGROUND OF THE INVENTION

1. Field of the Invention

The present invention is directed to the field of liquid level sensors and more specifically to the area of sensors that detect changes of liquid level about a predetermined level.

2. Description of the Prior Art

Liquid level sensors containing switches to indicate whether a sensed liquid is above or below a predetermined level are numerous in the prior art.

A liquid level system for detecting the level of vehicle engine oil is disclosed in U.S. Pat. No. 3,939,470, wherein thermistors are located at opposite sides of an oil reservoir exposed to the oil therein. The system detects variations in thermal dissipation at the thermistors when they are immersed in oil or exposed to the air above the oil. While the sensors themselves appear to be simple in construction, the system itself requires a rather complex circuit to monitor the sensors and make the determination as to whether the oil level has dropped below the predetermined level.

Another type of liquid level sensor is disclosed in U.S. Pat. No. 3,750,124 which utilizes a more complex sensor than that described in the above-noted patent and a relatively simple circuit to determine when the liquid level has dropped below a predetermined level. The system is shown incorporated in a vehicle brake master cylinder reservoir and utilizes an electrical reed switch sensor mounted horizontally in the vertical wall of the reservoir. The sensor incorporates a permanent magnet encapsulated in a float surrounding the reed switch. Whenever the liquid level is above the predetermined level, the float is buoyantly supported to its uppermost position and, depending upon the orientation of the sensor, places the magnet adjacent the bottom of the reed switch or floats the magnet above the reed switch. When the liquid level drops below the predetermined value, the float is lowered and causes the opposite effect on the reed switch due to the repositioning of the magnet with respect thereto. The associated circuit monitors the opening and closing of the reed switch to control the illumination of a warning lamp if the level has dropped below the predetermined level. The primary disadvantage of employing the reed switch sensor of the '124 patent is due to the requirement that the entire sensor be mounted in a particular orientation, with respect to the vertical, in order that the float containing the magnet is properly aligned for responding to buoyant forces or the lack thereof.

SUMMARY OF THE INVENTION

It is an object of the present invention to overcome the disadvantages of the prior art by providing a liquid level sensor switch that is both relatively simple in construction and dependable in its use, while at the same time being designed to have a predetermined float orientation independent of the orientation of its mounted housing. Those objects are achieved by a horizontally extending float element which contains exposed electrical contacts to perform switching between an electrical terminal within an associated housing and a grounded retainer cage when the liquid level changes about a predetermined level causing the contacts on the float to make or break in response to its position. The float element is predictably oriented by being weighted on one side thereof and retained within the retainer cage so as to freely rotate into a predictable orientation with respect to the vertical.

DETAILED DESCRIPTION OF THE PREFERRED EMBODIMENT

Figures 1, 2:
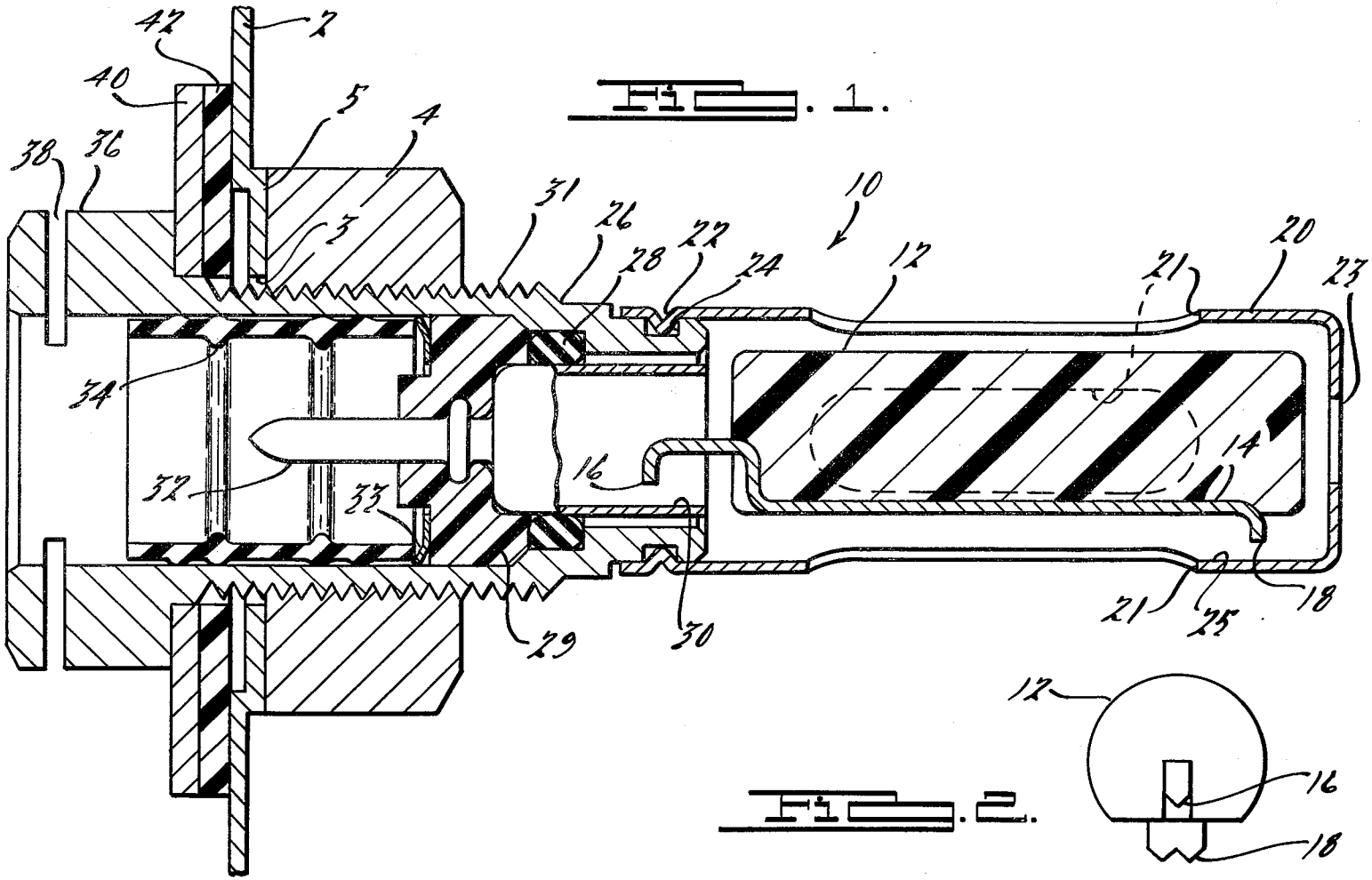
FIG. 1 is an elevational cross-section of the preferred embodiment of the present invention.
FIG. 2 is an end view of the weighted float element as shown in FIG. 1.

A preferred embodiment of the present invention is shown as a float sensor 10 in FIG. 1, horizontally mounted through an aperture 3 in a wall 2 which lies in a substantially vertical plane and is part of a liquid container, such as an oil reservoir of an automotive engine. Internally threaded nut 4 is welded to the internal side of the vertical wall 2, coaxial with the aperture 3, to provide a horizontal mounting for the float sensor 10.

This embodiment of the sensor 10 includes a generally cylindrical metal housing 26 having external threads 31 cut along its length so as to be threadable into the support nut 4. When mounted, the housing 26 defines an atmospheric end that is external to the container and a liquid contacting end internal to the container. The atmospheric end has a hex-head 36 with a central aperture to allow insertion and extraction of an electrical connector (not shown). The atmospheric end of the housing 26 also includes a slot 38 that will accept a locking spring (not shown) to hold the electrical connector in place. A flange 40 (in the alternative, a metal washer) is configured to extend from the housing 26 and functions with an associated phenolic washer 42 to provide a seal with respect to the container wall 2 and the aperture 3. The internal portion of the housing 26 provides for an electrical terminal 32 that is embedded in a block of insulator material 29 and retained therein. An O-ring 28 surrounds a portion of the terminal 32 to provide a seal to pressurized liquids within the container. The electrical terminal 32 has an elongated end which extends towards the atmospheric end opening of the housing 26 and a cup-shaped portion which opens to the liquid contacting end, and defines a cylindrical contact surface 30. The insulator block 29 and electrical terminal 32 are held in place within the housing 26 by a retainer spring clip 33. A rubber sleeve 34 is also provided within the housing 26 to provide hermetic sealing to a connector (not shown) when inserted.

The sensor 10 also includes an electrically conductive hollow retainer cage 20 that is crimped at 22 into a groove 24 formed near the liquid contacting end of the housing 26. The elongated retainer cage 20 is also generally cylindrical in shape and defines an internal chamber with a plurality of apertures 21 and 23 providing for relatively unrestricted flow of liquid therethrough.

A generally cylindrical float element 12 formed from a phenolic formed compound having a density that is less than the liquid of which the level is to be sensed. The float element 12 is configured to float freely within the internal chamber of the retainer cage 20 and is of sufficient size so as to have its length generally aligned with the axis of the cage 20.

The float 12 is provided with an electrical conductor 14 that is formed of a metal having a density that is greater than the liquid. The conductor 14 runs the length of the float element 12 and extends downward to an exposed contact point 18 opposite the inner conducting surface 25 of the retainer cage 20. The opposite end of the conductor 14 extends to an exposed contact point 16 which is opposite the inner surface 30 of the electrical terminal 32. In this embodiment, the electrical conductor 14 provides self-righting ballast (i.e., the center of gravity is displaced from the center of buoyancy) to the float element 12 so that the float element 12 will be pre-oriented by the force of gravity. In that manner, the electrical conductor 14 defines the bottom of the float element 12 that becomes properly oriented with the contact points 16 and 18 pointing in a downward direction no matter what angular orientation the sensor 10, assumes about its central axis as the housing 26 is tightly threaded into the nut 4.

In operation, when the liquid level is above a level, which is sufficient to apply float buoyant forces to the ballasted element 12, contact point 18, at the bottom of the ballasted float element 14, breaks electrical contact with the inner conducting surface of the retainer cage 20. If the liquid level drops sufficiently so that electrical contact is made at both contact points 16 and 18 to respective surfaces 30 and 25, an electrical path is completed between the terminal 32 and the housing 26. In this embodiment, the container wall 2 is electrically grounded so that the effect of a low liquid level is to cause grounding of the terminal 32. Appropriate circuitry can therefore be used to indicate a low liquid level.

It will be apparent that many modifications and variations may be implemented without departing from the scope of the novel concept of this invention. Therefore, it is intended by the appended claims to cover all such modifications and variations which fall within the true spirit and scope of the invention.

We claim:

1. A self-orienting liquid level sensor switch comprising:

means defining an electrically conducting housing;

means for attaching said housing to a substantially vertical wall of a liquid holding container;

means mounted within said housing defining an electrically isolated terminal;

means defining a generally cylindrical float element ballasted along its length;

apertured retaining means attached to said housing for surrounding and said blast element to limit the maximum movements of said float element; and electrically conductive means mounted on said float means to provide an electrical path between said terminal means and said retaining means attached to said housing when said liquid level is below a predetermined level.

2. A sensor as in claim 1, wherein said container wall contains a mounting aperture, said attaching means includes an internally threaded nut attached to said container wall coaxial with said aperture and said housing includes an external thread for mating with said nut and wherein said housing, said nut and said container wall are formed of electrically conductive material.

3. A sensor as in claim 1, wherein said ballasted float means is formed of a buoyant material, said electrically conducting means is formed of a non-buoyant material and said electrically conducting means is attached to said buoyant material to define the ballast of said float means and cause said float means to be predictably oriented by gravitational forces.

4. A sensor as in claim 1, wherein said housing and said retainer means are generally cylindrical in shape and said float means comprises a generally cylindrical shaped element extending along the longitudinal dimension of and within said retainer means; and said electrically conductive means includes a metal conductor extending along the length of said float means, having exposed ends at either end of said float means that are respectively held from contacting said retainer means and said terminal means when said float means is buoyant in a liquid having a level above a predetermined level with respect to said sensor and to respectively contact said retainer means and said terminal when said float element is allowed to drop due to said liquid being below said predetermined level.

5. A sensor as in claim 4, wherein said float element is formed of a material having a density which is less than the liquid having the level to be sensed and said metal conductor has a density greater than said liquid, so as to orient said float means with respect to said vertical in response to gravitational forces.

6. In a liquid level sensing system, whereby a sensor determines whether an associated non-conducting liquid is above or below a predetermined level in a liquid holding container, a sensor suitable for mounting through an aperture in a substantially vertical wall of said container comprising:

a cylindrical housing sealingly mounted with its length dimension lying in a horizontal plane within said aperture in any angular orientation about its central axis and defining a liquid contacting end within said container and an atmospheric end that is external to said container;

an electrical terminal within said housing, electrically isolated from said container and said housing and extending between said liquid contacting end and said atmospheric end of said housing;

a hollow retainer defining an internal chamber having one end connected to the liquid contacting end of said elongated housing and having a plurality of apertures for allowing the liquid to enter and exit its internal chamber;

a float element freely contained within said internal chamber of said hollow retainer; and means having a density greater than that of said float element attached to one side of said element for orienting said float element with respect to the vertical independent of the angular orientation of said housing as mounted in said vertical wall of said container and defining an electrical conductor for providing an electrical switching connection between said electrical terminal and said retainer, responsive to said liquid falling below said predetermined level.

7. A sensor as in claim 6, wherein said orienting and switching connection means comprises a single electrical conductor attached to said float element at a finite distance from the longitudinal axis of said float element so as to establish a predetermined orientation of said conductor and to allow performance of said switching function independent of the angular orientation of said housing.

8. A sensor as in claim 7, wherein said float element is formed in a generally cylindrical shape to loosely fit within said internal chamber and to be freely rotatable about its own longitudinal axis.

9. A liquid level sensor switch comprising:

a generally cylindrical float element formed of a material having a density that is less than the liquid intended to be sensed;

an electrical conductor element extending along the length of said generally cylindrical float element, having electrical contact points located at each end of said float element and being formed of a material having a density that is greater than said liquid intended to be sensed;

a housing element containing an insulated electrical terminal and defining an electrically conducting apertured hollow portion for retaining said generally cylindrical float element and providing electrical surfaces on said terminal and said hollow retaining portion adjacent respective electrical contact points on said float element whereby, when said float element is not buoyed by said liquid, said electrical conductor element completes an electrically conducting path between said terminal and said retaining portion.

10. A sensor as in claim 9, wherein said electrical conductor element forms a ballast on said cylindrical float element and maintains said electrical contact points oriented in a downward position.

* * * * *